US009428977B2

(12) United States Patent
Tait

(10) Patent No.: US 9,428,977 B2
(45) Date of Patent: Aug. 30, 2016

(54) MULTI-STAGE LOCKING SYSTEM FOR SELECTIVE RELEASE OF A POTENTIAL ENERGY FORCE TO SET A SUBTERRANEAN TOOL

(71) Applicant: Baker Hughes Incorporated, Houston, TX (US)

(72) Inventor: Alasdair R. Tait, Portlethen (GB)

(73) Assignee: Baker Hughes Incorporated, Houston, TX (US)

( * ) Notice: Subject to any disclaimer, the term of this patent is extended or adjusted under 35 U.S.C. 154(b) by 515 days.

(21) Appl. No.: 13/968,972

(22) Filed: Aug. 16, 2013

(65) Prior Publication Data

US 2015/0047824 A1 Feb. 19, 2015

(51) Int. Cl.
*E21B 23/01* (2006.01)
*E21B 34/06* (2006.01)

(52) U.S. Cl.
CPC ..... *E21B 23/01* (2013.01); *E21B 34/066* (2013.01)

(58) Field of Classification Search
CPC ..... E21B 23/01; E21B 34/066
See application file for complete search history.

(56) References Cited

U.S. PATENT DOCUMENTS 1,866,087 A * 7/1932 Crowell ..... E21B 23/01 166/210
3,264,994 A 8/1966 Leutwyler
3,739,845 A * 6/1973 Berry ..... E21B 34/16 137/71
RE30,988 E 7/1982 Crickmer
6,032,734 A * 3/2000 Telfer ..... E21B 23/00 166/106
7,413,028 B2 8/2008 Comarmond
7,562,712 B2 7/2009 Cho et al.
7,605,061 B2 10/2009 Takahashi et al.
7,626,393 B2 12/2009 De Jesus et al.
7,669,663 B1 3/2010 Hall et al.
7,703,532 B2 4/2010 O'Malley et al.
7,828,066 B2 11/2010 Jahn
8,893,807 B2 * 11/2014 Tait ..... E21B 23/00 166/208
2008/0011472 A1 1/2008 Fay
2009/0032238 A1 2/2009 Rogers et al.
2012/0211221 A1 8/2012 Mills et al.
2012/0234530 A1 9/2012 Tait
2013/0014959 A1 1/2013 Tips et al.

* cited by examiner

*Primary Examiner* — David Andrews
*Assistant Examiner* — Ronald Runyan
(74) *Attorney, Agent, or Firm* — Steve Rosenblatt

(57) ABSTRACT

An actuation tool uses a lock that when released allows a moving magnet to move into position to repel another magnet. Alternatively a magnetic field can be triggered in a stationary magnet such as one delivered on wireline, for example, to accomplish tool actuation. The repelling force on the second magnet moves it away from a locking position to allow another lock to retract and release the stored potential energy, where the release of the potential energy creates kinetic energy to drive an actuation assembly to set the tool. In a preferred application the tool can be a liner hanger. The release device can be a selectively energized electromagnet or a solenoid that shifts at least one magnet into alignment with at least one second magnet so as to defeat the second magnet from effectively supporting dogs that retain the potential energy whose movement can set the tool.

20 Claims, 4 Drawing Sheets

MULTI-STAGE LOCKING SYSTEM FOR SELECTIVE RELEASE OF A POTENTIAL ENERGY FORCE TO SET A SUBTERRANEAN TOOL

FIELD OF THE INVENTION

The field of the invention is actuation devices for subterranean tools and more particularly devices that enable selective remote actuation while avoiding wall openings and their associated seals that can present potential leak paths. The device will allow actuation of equipment without a need to have any plug in the tubing against which pressure has to be applied.

BACKGROUND OF THE INVENTION

Pressure actuated assemblies that are designed to selectively actuate a subterranean tool typically involves a ball seat and a ball that is dropped or pumped to the ball seat and landed. Once the ball is landed internal pressure is built up through a wall opening to a piston housing surrounding the main bore so that a tool can be actuated. Typically a piston receives the internal pressure through a wall port and has an opposite end referenced to annulus pressure. Raising the tubing pressure moves the piston which actuates the tool. In one example of a liner hanger, the piston can move slips and a sealing element to support a liner from a surrounding casing.

There can be issues with such a design. The tool can be in a long horizontal run so that it may take the ball a long time to get to the seat without having to be pumped. In a horizontal run the ball may not locate on the seat even with a flowing stream urging the ball to the seat. Wall openings to piston housings can also present potential leak paths if seals deteriorate or fail.

Accordingly, an actuation system is needed that can be selectively operated from a remote location to operate a tool at the desired location. In the preferred embodiment an actuation system is described that locks in potential energy with a lock that is disabled to release the potential energy to set the tool. In a preferred application a liner hanger slip system and seal can be set with the device. The lock is defeated with physical movement that is induced with an applied field or with an electromechanical device to name a few preferred options. In one embodiment the field is magnetic and the release is accomplished with a repelling response to a magnet while other locking dogs serve at least in part as a locking key for the potential energy that actuates the tool when ultimately released. Those skilled in the art will better appreciate aspects of the preferred embodiments of the invention from a review of the description of the preferred embodiment and the associated FIGS. while recognizing that the full scope of the invention is to be found in the appended claims.

U.S. Publication 2012/0234530 A1 has a locking dog system that is put under load by the potential energy force that will ultimately set the tool. The potentially high force that can be needed to set the tool exerts a high friction force on the locking dog member that can make it hard to move the dog sufficiently to release the stored potential energy force. The objective of the present invention is to control the friction load on the locking dogs that respond to the indirect force such as an applied magnetic field to then allow other dogs that hold the actuating potential energy force to release the setting potential energy force. Doing this reduces or eliminates a sticking situation when trying to use an indirect force of limited quantity to move a lock member being pushed on with a very large actuating force for the associated tool.

U.S. Pat. No. 7,703,532 illustrates moving a magnet in position to hold open a flapper in a safety valve in the open position and to reduce its tendency to chatter in the open position. U.S. Publication 2009/0032238 illustrates a magnet used to assist the movement of a flapper in a safety valve to go to an open position by adding to the gravity force of the flapper weight that tends to move it to the open position. Another magnet can be used to urge the flapper to the closed position. U.S. Pat. No. 7,828,066 transmits power through a magnetic shaft coupling. U.S. Pat. No. 3,264,994 shows the use of a magnet on a dart that is pumped past a tool to use the field to trigger tool actuation. U.S. Publication 2010/0126716 illustrates a hard wired system for initiating tool actuation using a magnetic field. Other patents of interest with regard to the present invention are: U.S. Pat. Nos. RE 30,988; 7,703,532; 7,669,663; 7,562,712; 7,604,061; 7,626,393 and 7,413,028.

SUMMARY OF THE INVENTION

An actuation tool uses a lock that when released allows a moving magnet to move into position to repel another magnet. Alternatively a magnetic field can be triggered in a stationary magnet such as one delivered on wireline, for example, to accomplish tool actuation. The repelling force on the second magnet moves it away from a locking position to allow another lock to retract and release the stored potential energy, where the release of the potential energy creates kinetic energy to drive an actuation assembly to set the tool. In a preferred application the tool can be a liner hanger. The release device can be a selectively energized electromagnet or a solenoid that shifts at least one magnet into alignment with at least one second magnet so as to defeat the second magnet from effectively supporting dogs that retain the potential energy whose movement can set the tool.

DETAILED DESCRIPTION OF THE PREFERRED EMBODIMENT

Figure 1:
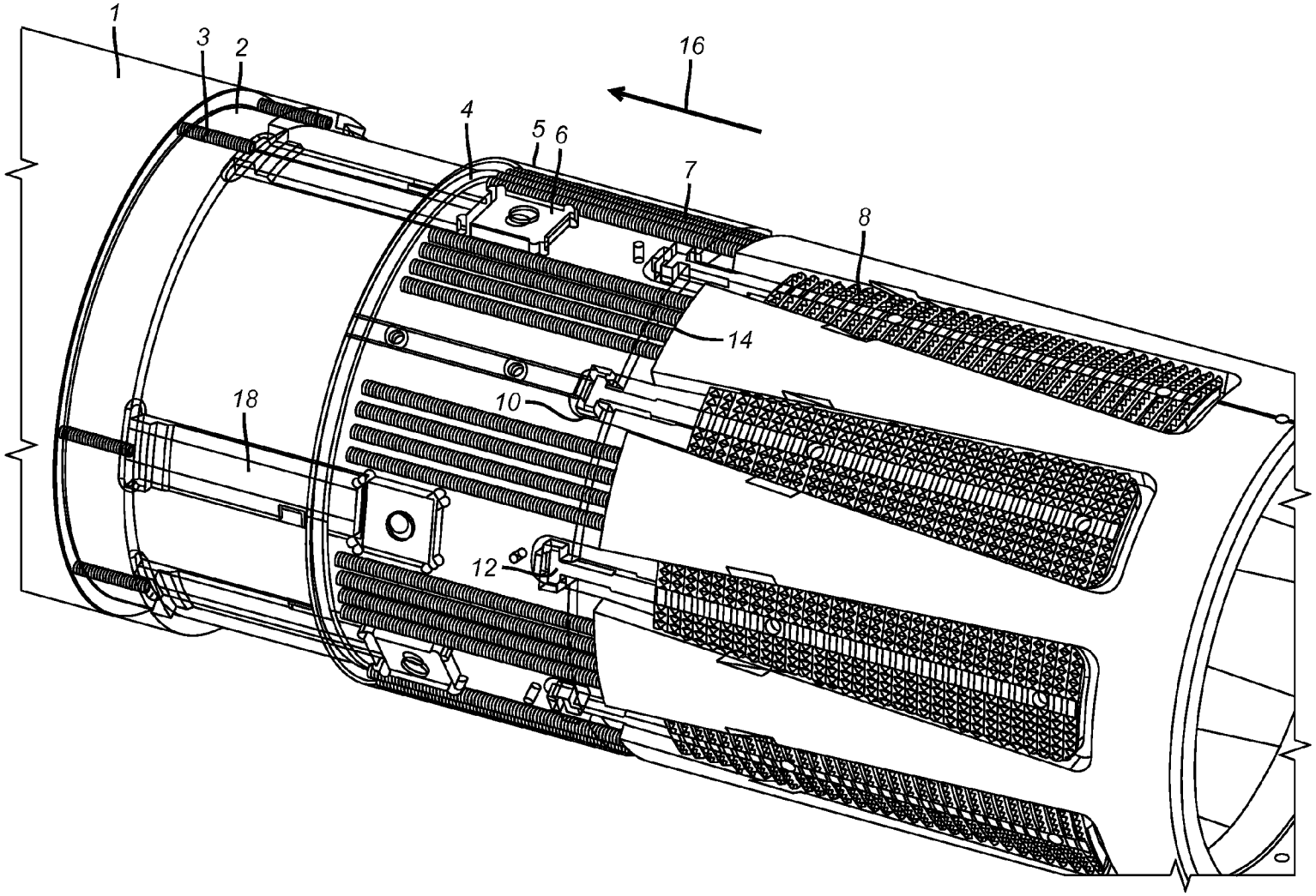
FIG. 1 is a perspective view of an application of the lock in a liner hanger shown in the run in position.
Figure 2:
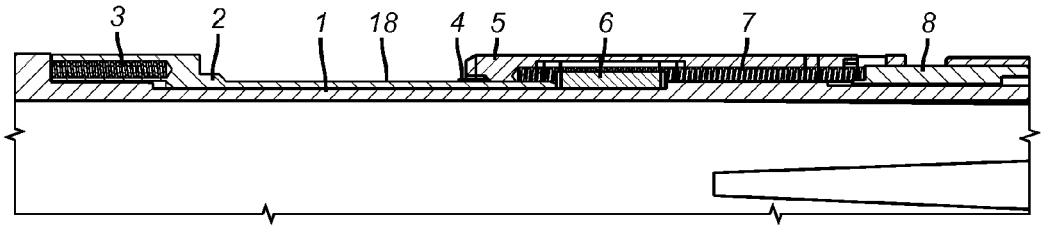
FIG. 2 is a section view through FIG. 1.
Figure 5:
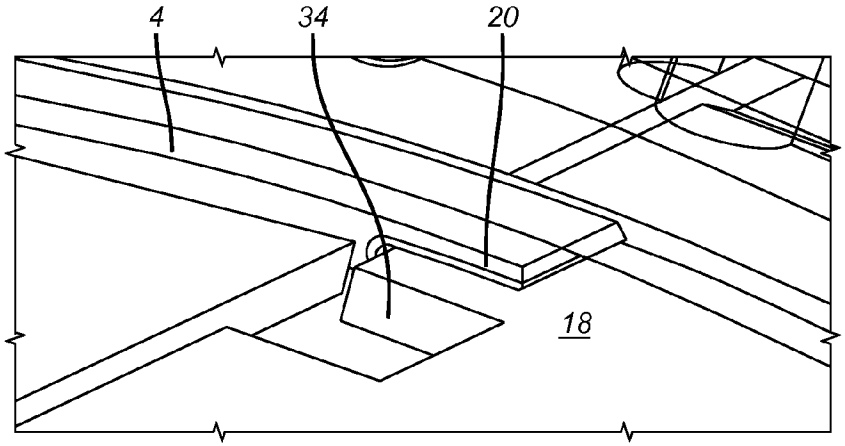
FIG. 5 shows the run in view with the dogs that retain the setting force enabled.

FIG. 1 shows an application in a liner hanger but the invention is applicable to subterranean tools in general. The slips 8, which can also be considered the final controlled element of a subterranean tool that in this case of the preferred embodiment is a liner hanger, are operably connected to ring 5 that has openings 10 into which conforming ends 12 of the slips 8 are located. The mandrel 1 supports springs 7, which are considered the first potential energy source, at support surfaces 14. The actuating ring 5 is prevented from moving uphole or in the direction of arrow 16 by dogs 4 that are considered the first detent and are supported for radial extension by fingers 18 that extend from release ring 2. FIG. 5 shows a close up view of a finger 18 and the dog 4 showing a cantilevered end 20 that is held out radially by an adjacent finger 18. The same view in section is shown in FIG. 2 where one of the fingers 18 is seen holding an adjacent dog 4 radially outwardly to extend beyond surface 22 of the mandrel 1 in such a way that the actuating ring 5 cannot move in the direction of arrow 16 because sloping surface 24 on actuating ring 5 engages sloping surface 26 on the dog 4 such that the upper end 26 of dog 4 abuts surface 28 of groove 30 in mandrel 1. Thus the force of springs 7 is contained during running in because fingers 18 hold dogs 4 in the FIG. 3 position effectively preventing movement of actuating ring 5 that sets the slips 8.

Figure 6:
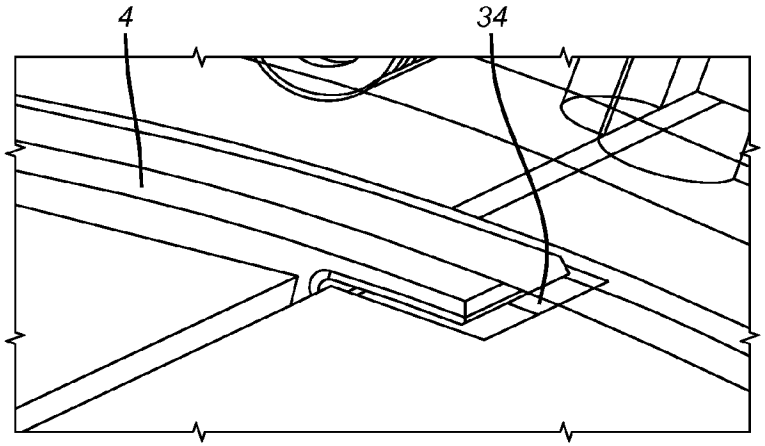
FIG. 6 is the view of FIG. 5 showing the dogs that retain the setting force released to radially retract.
Figure 7:
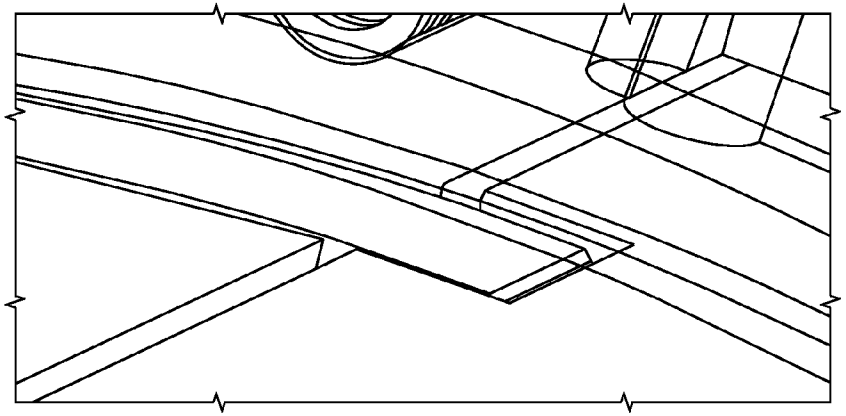
FIG. 7 is the view of FIG. 6 showing the dogs that retain the setting force radially retracted.
Figure 8:
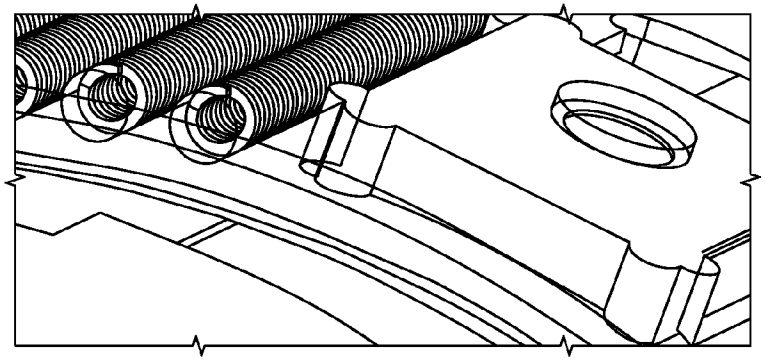
FIG. 8 is the view of FIG. 7 with the potential energy released so that the movement of the setting ring sets the slips of the tool.

FIGS. 9-12 illustrate one setting sequence in a design that has no wall openings in the mandrel 1. A tool X that is capable of moving the retainer 6, which is considered the second detent, in a radial direction without direct contact is moved in the downhole direction of arrow 32. As best seen in FIG. 2 in the run in position the placement of retainer 6 holds ring 2 in the position where dogs 4 are extended to hold the actuating ring 5 from moving. Radial movement of retainer 6 allows dog release ring 2 to move under the influence of springs 3, considered to be the second potential energy source. As previously explained, axial movement of dog release ring 2 in the direction of arrow 32 will allow the dogs 4 to move radially toward mandrel 1 as the slot 34 aligns with opposed cantilevered ends 20 as best seen when comparing FIGS. 5 and 6. FIG. 7 shows the dogs 4 fully in the slot 34 so that springs 7 can move the actuating ring 5 in the direction of arrow 16 to extend the slips 8 to effectively set the tool. FIG. 8 shows the onset of motion of the actuating ring 5 after the dogs 4 are fully retracted.

Figure 4A:
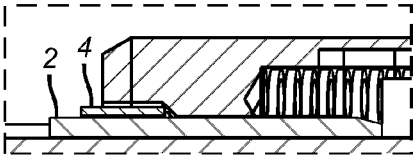
FIG. 4A is an enlarged view of the dashed box in FIG. 4.
Figure 4:
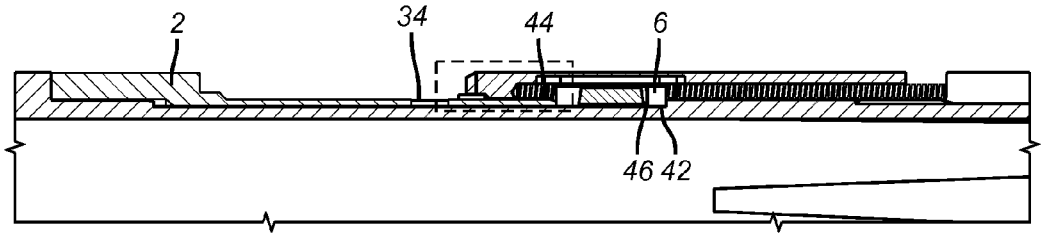
FIG. 4 is another section view through FIG. 1 and offset 6 degrees from FIG. 2.
Figure 9:
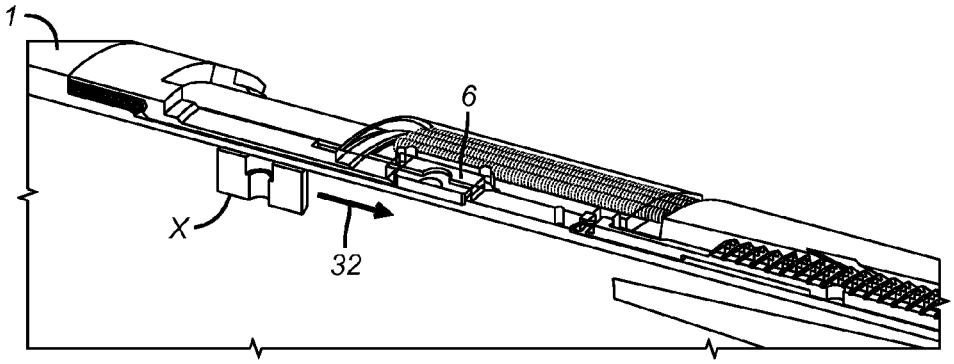
FIG. 9 is a perspective view of a magnetic tool being brought into position for setting the tool.
Figure 10:
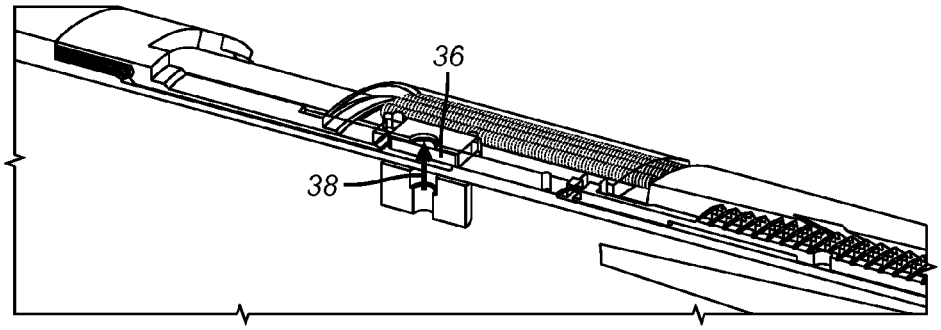
FIG. 10 is the view of FIG. 9 showing initial movement of dogs moving radially by virtue of the magnetic field to enable subsequent movements to set the tool.
Figure 11:
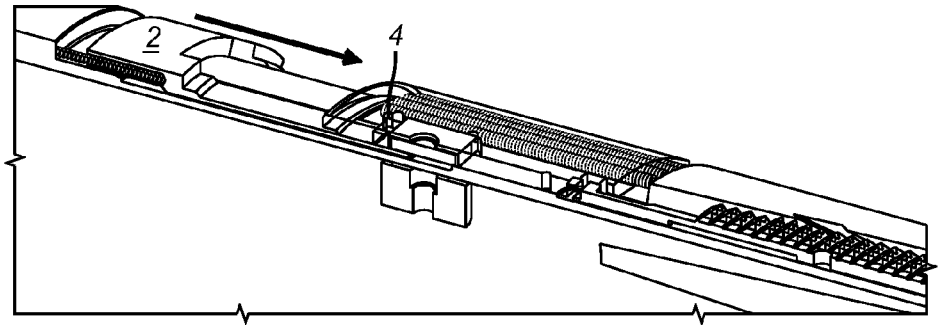
FIG. 11 is the view of FIG. 10 showing movement of a first ring, that disables locking dogs that release the potential energy for setting the tool.
Figure 12:
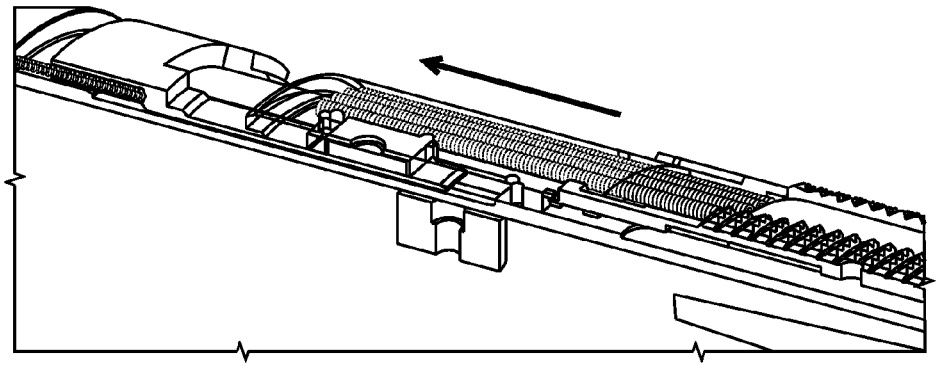
FIG. 12 is the view of FIG. 11 with the potential energy released so that the tool can set.

Referring to FIGS. 4 and 9 it can be seen that retainer 6 is a housing that surrounds a magnet or magnets or other material responsive to the tool X when they are brought in close proximity as shown in FIG. 10. As a result the effect of the magnetic field the magnet 36 is repelled in the direction of arrow 38 taking the retainer with it so that the release ring 2 that was held back against the force of springs 3 can now advance axially in the direction of arrow 32 as is best seen when comparing FIGS. 10 and 11. Because the dogs 4 have retracted into groove 34 as a result of movement of release ring 2 under the force of springs 3, the actuating ring 5 can now be biased to move in the direction of arrow 40 to set the slips 8 as shown in FIG. 12. The tool X can now be repositioned or removed from the borehole.

Referring to FIG. 4 it can be seen that the retainer 6 is pushed against surface 42 of mandrel 1 by the lower end 44 of the release ring 2 acting under bias from springs 3 that are fairly weak essentially only needing to produce enough force to slide release ring 2 when the retainer 6 is moved radially away from mandrel 1 with tool X. This means that the friction force that has to be overcome between the retainer 6 and the surface 42 is fairly minimal. This is to be contrasted with the design in U.S. Publication 2012/0234530 where the load from the actuating springs that set the tool is held by the equivalent of the retainer 6 which in turn requires a much larger force to be applied to overcome frictional resistance. The required force to overcome friction in the prior tool could be so high that the magnetic field that was used to try to move the retainer was insufficient to initiate the setting process unless the spring force of the actuating springs in that design were reduced. Instead, in the present invention, the friction force against surface 42 is minimized because the source of such a force when trying to move the retainer 6 in the direction of arrow 38 is minimal as its source in springs 3 is minimal and orders of magnitude less than if the actuation springs applied the force as in U.S. Publication 2012/0234530.

It should be noted that a leaf spring or equivalent 46 that is schematically illustrated can hold the retainer 6 against mandrel 1 during running in to prevent inadvertent tool actuation.

Figure 3A:
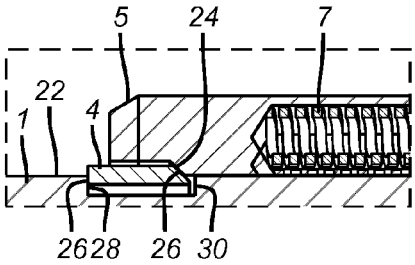
FIG. 3A is an enlarged view of the dashed box in FIG. 3.
Figure 3:
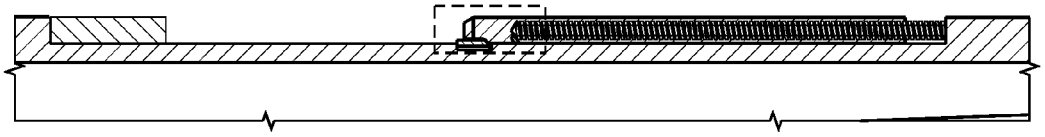
FIG. 3 is another section view through FIG. 1 and offset 12 degrees from FIG. 2.

Referring to FIG. 3 the actuating ring 5 has a tapered leading surface 24 that uses the large force available from springs 7 to cam the dogs 4 into slots 30 as soon as axial movement of release ring 2 enables the dogs 4 to be pushed in radially using surface 24. The available three from springs 7 is so great as to easily overcome resisting friction forces against surfaces 28.

The present invention can be used to actuate any subterranean tool with a released potential energy source. Although springs 7 are illustrated for that purpose, pressurized fluid or pressure in control lines from the surface or other location can be used. Hydrostatic pressure against an atmospheric chamber can also be deployed. Similarly, alternative sources of potential energy for springs 3 are contemplated. The actuation can be initiated with tool X and employ a magnetic field as explained or other techniques that do not require holes in the wall of mandrel 1 can be employed to move the retainer 6 away from mandrel 1 to get the setting process started. For example, the tool X can flex the wall of mandrel 1 elastically. A cam can lift the retainer 6 in response to a surface signal that is processed locally to drive the cam and raise the retainer 6. A sealed volume outside the mandrel 1 and below the retainer 6 can be employed to move the retainer 6 radially away from mandrel 1 using well fluid pressure in the annulus or delivered from auxiliary lines from the surface or another location.

The use of opposed movement for setting the tool allows for a lightly loaded retainer 6 that can respond to an actuation force that is modest without having to overcome frictional forces of a much higher magnitude such as when the large potential energy force that sets the tool is also retained by the same retainer that has to move to release the setting force. Instead by using opposed movements to set the tool, the generated force to initiate the setting of the tool can be modest such as is needed to overcome friction forces created with springs 3 that only need to be strong enough to move the release ring 2 so that the dogs 4 can drop out of the way to let the tool set. The movement of the actuating ring 5 is in an opposed direction to release ring 2. This allows the use of tool X using for example a magnetic field to have enough energy to move the retainer 6 while at the same time allowing springs 7 to be as strong as needed. A bi-directional setting sequence allows the separation of the setting function potential energy from the locking mechanism to then permit a much lower force to enable the setting in the form of the actuation tool such as a source of electromagnetic energy. The separation allows the use of lower energy actuation because the components move independently of the actuating ring 5 that sets the tool, which in the case of the preferred embodiment is a liner hanger.

The above description is illustrative of the preferred embodiment and many modifications may be made by those skilled in the art without departing from the invention whose scope is to be determined from the literal and equivalent scope of the claims below:

I claim:

1. An actuation assembly for a subterranean tool, comprising:

a mandrel supporting a final controlled element;

a first potential energy source associated with said mandrel;

a first detent assembly to selectively isolate said potential energy source from said final controlled element:

a second detent assembly selectively operable independently of said first potential energy source and said first detent assembly, said second detent assembly when selectively defeated by a first mechanical movement, thereafter, defeats said first detent assembly by a second mechanical movement to allow said first potential energy source to move said final controlled element.

2. The assembly of claim 1, wherein:

said first detent assembly moves in an opposite direction than said second detent assembly.

3. The assembly of claim 1, wherein:

said second detent assembly is selectively driven by a second potential energy source.

4. The assembly of claim 3, wherein:

said second potential energy source is weaker than said first potential energy source.

5. An actuation assembly for a subterranean tool, comprising:

a mandrel supporting a final controlled element;

a first potential energy source associated with said mandrel;

a first detent assembly to selectively isolate said potential energy source from said final controlled element;

a second detent assembly selectively operable independently of said first potential energy source, said second detent assembly, when selectively defeated, defeats said first detent assembly to allow said first potential energy source to move said final controlled element;

said first detent assembly comprises an actuating member connected to said final controlled element, said actuating member located between said first potential energy source and at least one dog, said dog having a radially extended position that prevents movement of said actuating member by said first potential energy source;

said dog is retained in said radially extended position by said second detent assembly.

6. The assembly of claim 5, wherein:

said second detent assembly initially disposed between said mandrel and said at least one dog to support said at least one dog in said first position of said at least one dog, whereupon relative movement of said second detent assembly with respect to said at least one dog allows said at least one dog to move to a second position allowing said first potential energy source to move said actuating member and final controlled element.

7. The assembly of claim 6, wherein:

said second detent assembly initially positioned radially between said mandrel and said at least one dog to allow said dog to block movement of said actuating member;

whereupon axial movement of said second detent assembly allows said at least one dog to move radially toward said mandrel into a second position and out of a path of movement of said actuating member.

8. The assembly of claim 7, wherein:

said actuating member moves over said at least one dog when said dog is in said second position.

9. The assembly of claim 7, wherein:

said at least one dog comprises at least one cantilevered end;

said second detent assembly comprises at least one elongated member selectively supporting said cantilevered end until a slot on said elongated member aligns with said cantilevered end allowing said at least one dog to move toward said mandrel.

10. The assembly of claim 9, wherein:

said actuating member comprising a leading tapered surface to cam said at least one dog into a mandrel slot when said slot on said at least one elongated member aligns with said cantilevered end of said at least one dog.

11. The assembly of claim 10, wherein:

said at least one dog comprises a plurality of dogs each having opposed cantilevered ends;

said at least one elongated member comprises a plurality of spaced elongated members extending from a base ring, said elongated members located on opposed sides of said dogs and selectively engaging said opposed cantilevered ends.

12. The assembly of claim 11, wherein:

said base ring is biased by a second potential energy source for selective movement in an opposed direction than said actuating member.

13. The assembly of claim 12, wherein:

said second potential energy source comprises at least one spring that is weaker than another at least one spring that comprises said first potential energy source.

14. The assembly of claim 9, wherein:

said at least one elongated member selectively prevented from moving axially when biased by a second potential energy source by a radially movable member that abuts said mandrel.

15. The assembly of claim 14, wherein:

said radially movable member is indirectly actuated to move radially with respect to said mandrel to allow said elongated member to move under bias from said second potential energy source.

16. The assembly of claim 15, wherein:

said radially movable member is actuated with a magnetic field applied from within said mandrel.

17. The assembly of claim 16, wherein:

said second potential energy source comprises at least one release spring that is weaker than at least one actuating spring that comprises said first potential energy source.

18. The assembly of claim 17, wherein:

said at least one release spring creating a frictional resistance to radial movement of said radially movable member, said frictional resistance is overcome by said magnetic field.

19. The assembly of claim 18, wherein:

said actuating member is biased by said actuating spring in an opposite direction than said release spring biases said at least one elongated member.

20. The assembly of claim 19, wherein:

initial movement of said at least one elongated member allows said dog to move away from said actuator so that said actuating spring can move said actuator and said final controlled element.

* * * * *